US010811821B2

(12) United States Patent
Aoshima

(10) Patent No.: US 10,811,821 B2
(45) Date of Patent: Oct. 20, 2020

(54) CONNECTOR DEVICE

(71) Applicant: YAZAKI CORPORATION, Tokyo (JP)

(72) Inventor: Kengo Aoshima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/442,176

(22) Filed: Jun. 14, 2019

(65) Prior Publication Data

US 2019/0386432 A1 Dec. 19, 2019

(30) Foreign Application Priority Data

Jun. 19, 2018 (JP) ..... 2018-116167

(51) Int. Cl.
*H01R 13/64* (2006.01)
*H01R 13/631* (2006.01)
*H01R 13/11* (2006.01)

(52) U.S. Cl.
CPC ..... *H01R 13/631* (2013.01); *H01R 13/111* (2013.01)

(58) Field of Classification Search
CPC .... H01R 13/631; H01R 13/111; H01R 13/44; H01R 13/6453; H01R 13/642; H01R 13/04; H01R 13/629; H01R 13/447; H01R 13/582
USPC ..... 439/374
See application file for complete search history.

(56) References Cited

U.S. PATENT DOCUMENTS

| | | | | |
|---|---|---|---|---|
| 10,389,056 | B2 * | 8/2019 | Suzuki | H01R 13/447 |
| 2015/0099391 | A1 | 4/2015 | Hashimoto et al. | |
| 2015/0229054 | A1 | 8/2015 | Fukushima et al. | |
| 2016/0111831 | A1 * | 4/2016 | Kawai | H01R 13/04 439/620.21 |
| 2016/0126681 | A1 * | 5/2016 | Kawai | H01R 13/582 439/620.21 |
| 2017/0194740 | A1 | 7/2017 | Nakazawa | |
| 2018/0048090 | A1 * | 2/2018 | Kawai | H01R 13/5812 |

(Continued)

FOREIGN PATENT DOCUMENTS

| | | | |
|---|---|---|---|
| EP | 3 190 667 | A1 | 7/2017 |
| JP | 2014-63687 | A | 4/2014 |
| JP | 2017-123223 | A | 7/2017 |

(Continued)

*Primary Examiner* — Jean F Duverne
(74) *Attorney, Agent, or Firm* — Kenealy Vaidya LLP

(57) ABSTRACT

A connector device has a first connector including a male terminal which is rod-shaped, and a second connector including a female terminal to which the male terminal is electrically connected, in which the second connector includes an guide portion which is made of an insulating resin, the guide portion includes a hole portion for guiding the male terminal to the female terminal such that the hole portion is formed to have a diameter larger than an outer diameter of the male terminal, at least one groove portion is formed on an outer peripheral surface of the male terminal in an axial direction of the male terminal, and a protruding portion is provided on an inner peripheral surface of the hole portion, the protruding portion being inserted through the groove portion of the male terminal to be inserted into the hole portion and connected to the female terminal.

4 Claims, 7 Drawing Sheets

(56) References Cited

U.S. PATENT DOCUMENTS

2020/0185853 A1 6/2020 Uno et al.

FOREIGN PATENT DOCUMENTS

JP 2018-26288 A 2/2018
WO 2018/043271 A1 3/2018

* cited by examiner

CONNECTOR DEVICE

CROSS-REFERENCE TO RELATED APPLICATIONS

This application is based on and claims priority under 35 USC 119 from Japanese Patent Application No. 2018-116167 filed on Jun. 19, 2018, the contents of which are incorporated herein by reference.

TECHNICAL FIELD

The present invention relates to a connector device.

BACKGROUND ART

As a connector device corresponding to a large current, for example, a charging connector used for charging a battery mounted on a vehicle such as an electric vehicle or a plug-in hybrid vehicle is known (see, for example, JP 2014-063687 A and JP 2018-026288 A). In such a charging connector, for example, a male terminal includes a tip insulating portion having electrical insulation properties projecting forward from a tip end, and a female terminal is disposed at a position retracted from an end surface of a housing, so that finger touch to the conductive portion of the male terminal and the female terminal is prevented.

In order to realize the large current of the connector device, it is necessary to increase a diameter of the male terminal. Nevertheless, when the diameter of the male terminal is increased, a diameter of a guide hole formed in the housing or the like that guides the male terminal to the female terminal must also be increased, and sufficient finger touch prevention for the female terminal may not be obtained.

SUMMARY OF INVENTION

Illustrative aspects of the present invention provide a connector device capable of realizing a large current while ensuring finger touch prevention in a female terminal.

According to the illustrative aspect of the present invention, a pair of protruding portions which is inserted through the two groove portions formed on the male terminal is provided on the inner peripheral surface of the guide hole formed in the guide portion made of an insulating resin, the guide hole being provided in the connection end with the male terminal in the female terminal. Accordingly, the guide hole of the guide portion connected to the female terminal can be narrowed without preventing the connection with the male terminal. Therefore, by increasing the diameter of the male terminal 30 in order to cope with the large current, even when the diameter of the guide hole 53 increases, the finger touch prevention can be secured with respect to the conductive portion of the female terminal 70 while suppressing the increase in size.

According to the illustrative aspect of the present invention, by assembling the guide portion formed as an insulating resin component to the connection end of the female terminal, an excellent finger touch prevention with respect to the conductive portion of the female terminal can be easily secured.

According to the illustrative aspect of the present invention, by providing the protruding portions on the front holder, the guide hole connected to the female terminal can be narrowed, and an excellent finger touch prevention can be easily secured.

According to an illustrative aspect of the present invention, it is possible to provide a connector device capable of realizing a large current while ensuring finger touch prevention for a female terminal.

The illustrative aspects of the present invention has been briefly described above. Details of the present invention are further clarified by reading through the illustrative aspects (hereinafter, referred to as "exemplary embodiments") described below with reference to the accompanying drawings.

DETAILED DESCRIPTION

Hereinafter, exemplary embodiments of the present invention will be described in detail with reference to the drawings.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

Figure 1:
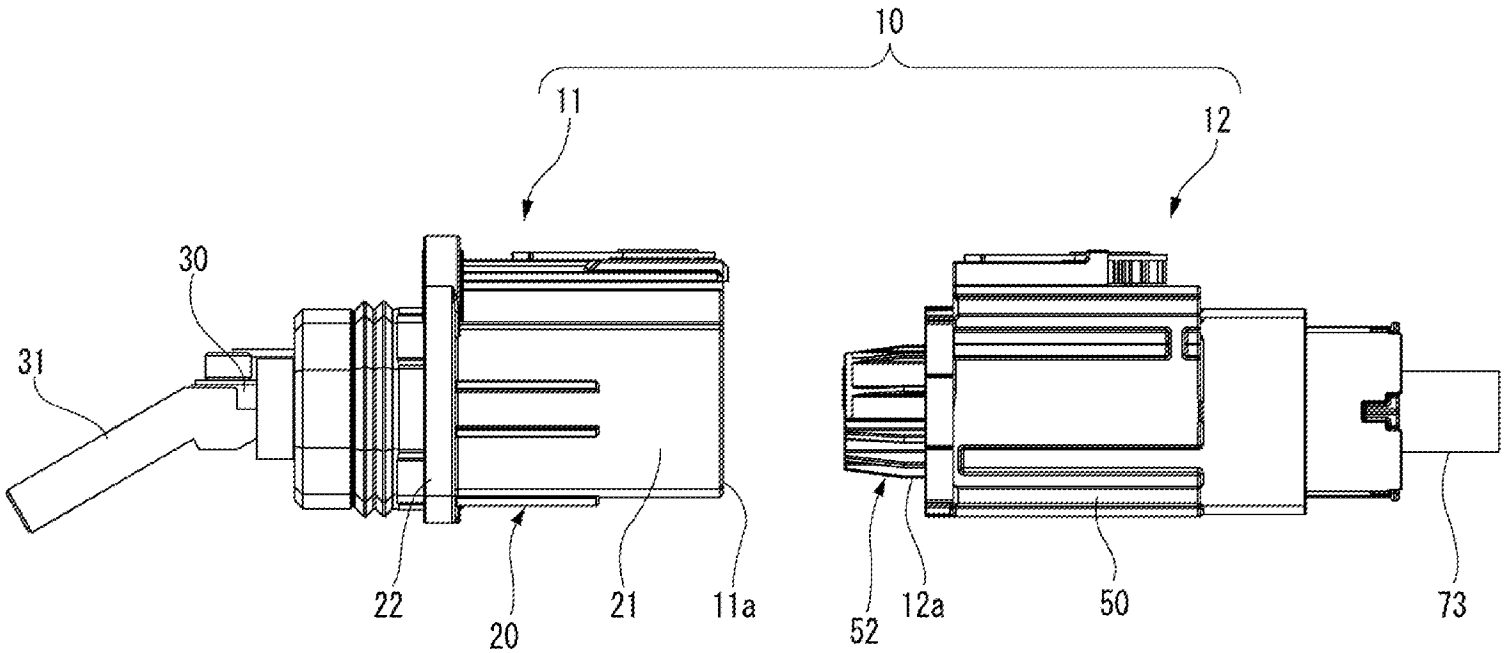
FIG. 1 is a side view of a first connector and a second connector included in a connector device according to an exemplary embodiment of the present invention.
Figure 2:
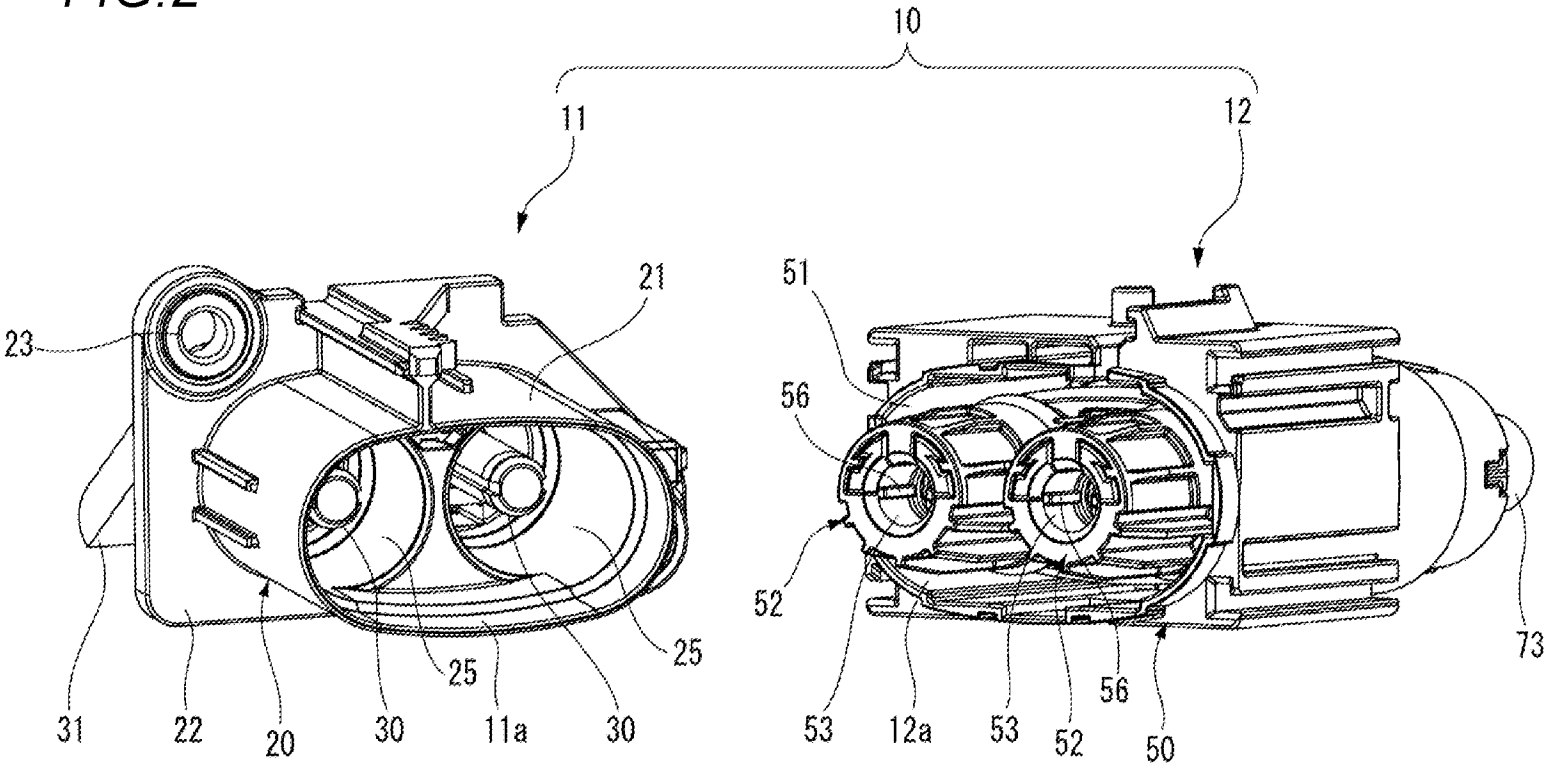
FIG. 2 is a perspective view of the first connector and the second connector included in the connector device according to the exemplary embodiment of the present invention as viewed from a connection portion side.

FIG. 1 is a side view of a first connector 11 and a second connector 12 included in a connector device 10 according to the exemplary embodiment of the present invention. FIG. 2 is a perspective view of the first connector 11 and the second connector 12 included in the connector device 10 according to the exemplary embodiment of the present invention as viewed from a connection portion side.

As shown in FIG. 1 and FIG. 2, the connector device 10 according to the illustrative aspect of present invention includes the first connector 11 and the second connector 12. Tip end portions of the first connector 11 and the second connector 12 are respectively formed as connection portions 11*a*, 12*a*, and the first connector 11 and the second connector 12 are fitted and connected to each other by abutting the connection portions 11*a*, 12*a* thereof.

The first connector 11 includes a housing 20 and male terminals 30. The housing 20 is formed of a synthetic resin having electrical insulation properties, and includes a hood portion 21 and a flange portion 22. A pair of fitting holes 25 having a circular cross section are formed inside the hood portion 21, and the male terminals 30 are provided at the center of the fitting holes 25 along the axial direction. The flange portion 22 is formed so as to protrude toward the outer circumference of the housing 20, and an insertion through hole 23 penetrating in the thickness direction is formed at an opposite position across the hood portion 21. The first connector 11 is attached to a mounting panel or the like by screwing a bolt (not shown) inserted through the insertion through hole 23 into a screw hole such as the mounting panel and fastening the flange portion 22. Connecting rods 31 made of a conductive metal material are provided on a rear portion of the first connector 11. The connecting rods 31 are connected to the male terminals 30 protruding from the rear end of the housing 20, and are connected to a circuit such as a power supply circuit via the connecting rods 31.

Figure 3:
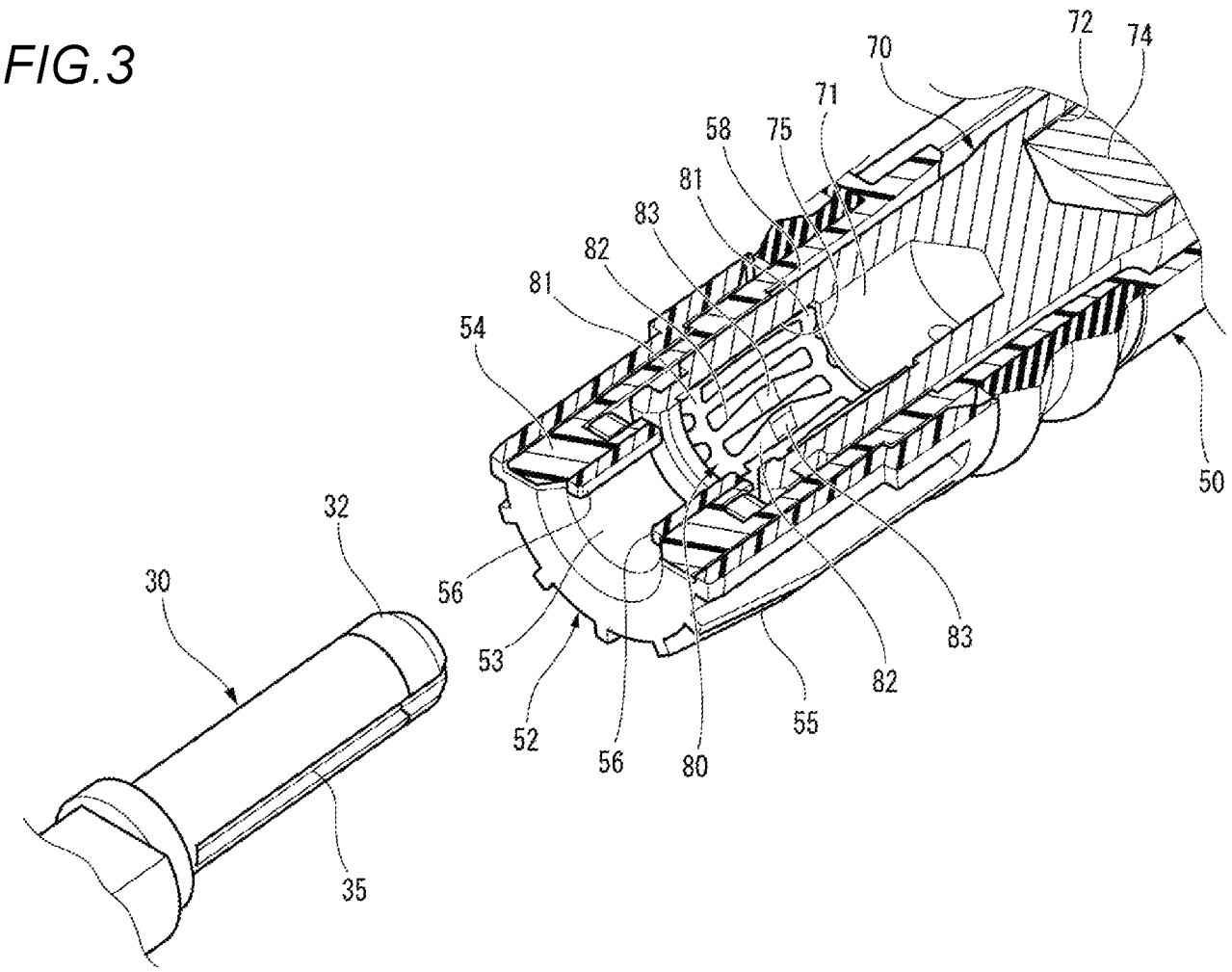
FIG. 3 is a perspective view illustrating a connection structure of a male terminal and a female terminal in a sectional view of the female terminal.
Figure 4:
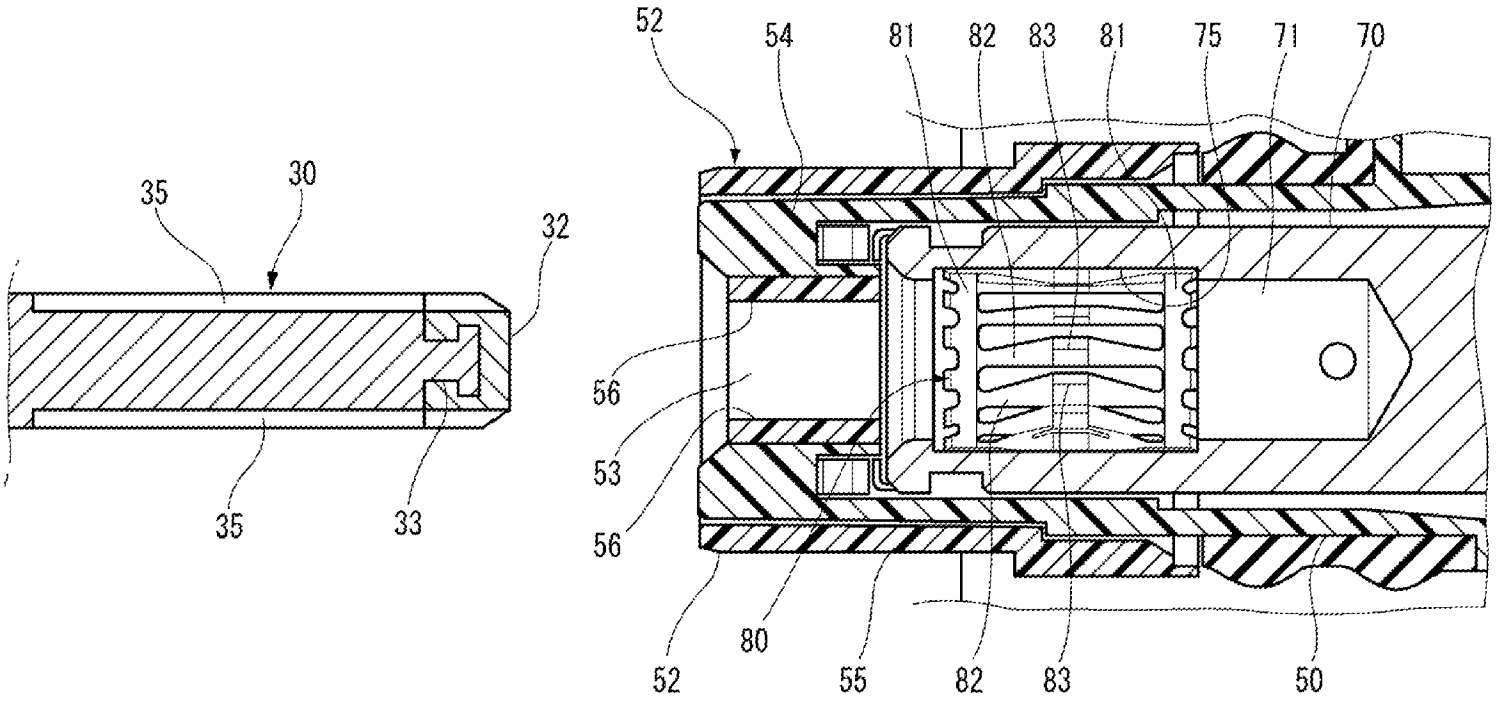
FIG. 4 is a sectional view of the male terminal and the female terminal illustrating the connection structure of the male terminal and the female terminal.

FIG. 3 is a perspective view illustrating a connection structure of the male terminal 30 and a female terminal 70 in a sectional view of the female terminal. FIG. 4 is a sectional view of the male terminal 30 and the female terminal 70 illustrating the connection structure of the male terminal 30 and the female terminal 70.

As shown in FIG. 3 and FIG. 4, the male terminal 30 provided in the fitting hole 25 is formed of a conductive metal material, and the male terminal 30 is formed in a cylindrical rod shape. An insulating cap 32 is attached to a tip end portion of the male terminal 30. The insulating cap 32 is formed of a synthetic resin having electrical insulation properties. The male terminal 30 includes a small diameter portion 33 in the vicinity of the tip end portion. The insulating cap 32 is mounted so as to cover the tip end portion of the male terminal 30 by locking the small diameter portion 33 of the male terminal 30. Further, the male terminal 30 to which the insulating cap 32 is mounted includes two groove portions 35 along the axial direction on the outer peripheral surface thereof. These groove portions 35 are formed on opposite sides across the center axis of the male terminal 30.

As shown in FIG. 1 to FIG. 4, the second connector 12 includes a housing 50 and the female terminal 70. The housing 50 is formed of a synthetic resin having electrical insulation properties, and a fitting recessed portion 51 is formed on the front surface side. A pair of cylindrical guide portions 52 protruding forward from the housing 50 are provided in the fitting recessed portion 51. The guide portion 52 is an insulating resin component to be assembled to a connection end of the female terminal 70. The guide portion 52 has a guide hole (hole portion) 53, and the male terminal 30 can be inserted through the guide hole 53.

Figure 5:
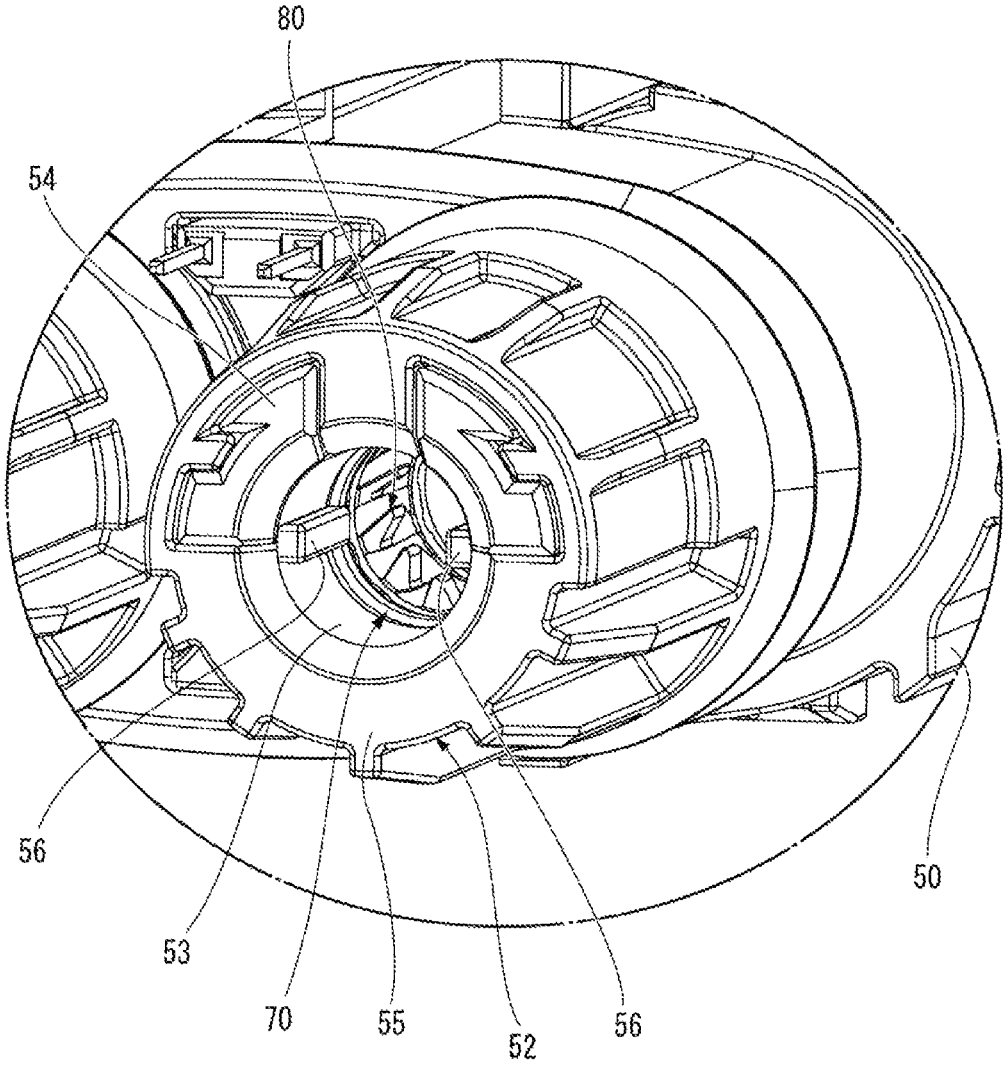
FIG. 5 is an enlarged perspective view of a guide portion of the second connector.
Figure 6:
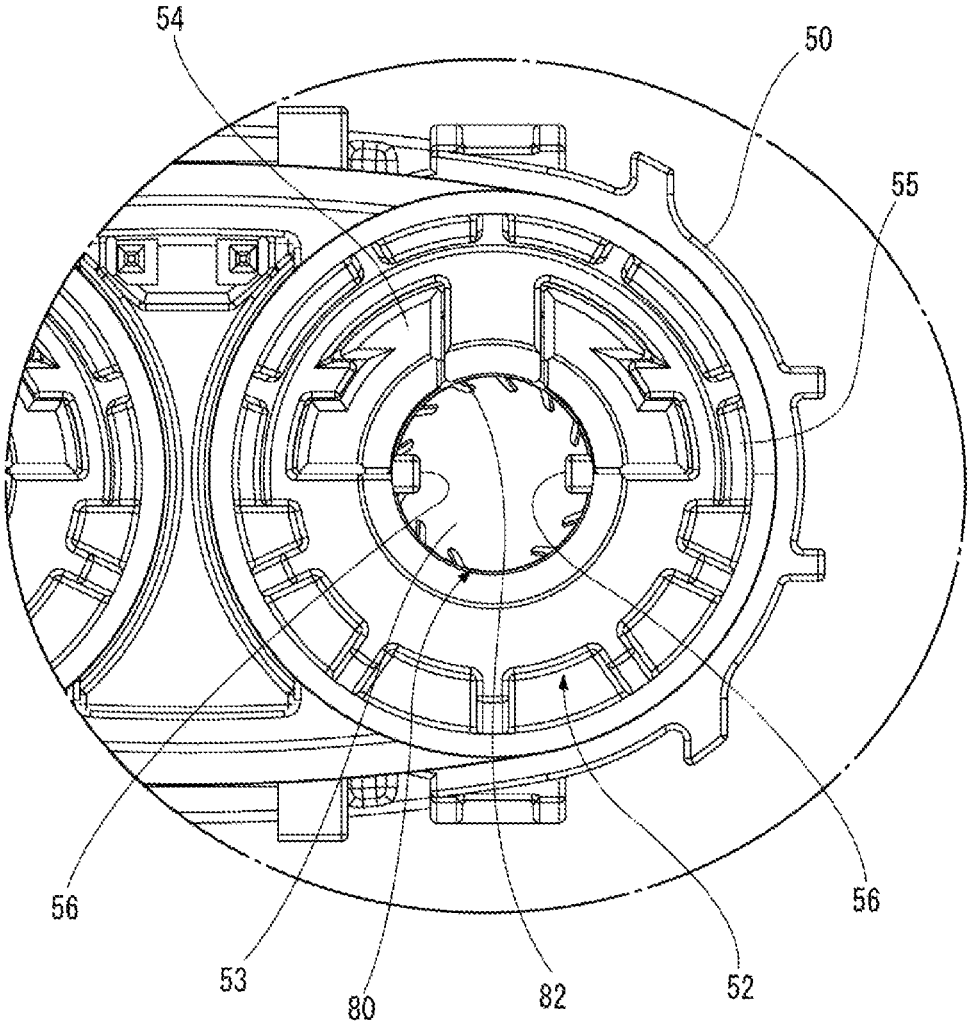
FIG. 6 is a front view of the guide portion of the second connector shown in FIG. 5.

FIG. 5 is an enlarged perspective view of the guide portion 52 of the second connector 12. FIG. 6 is a front view of the guide portion 52 of the second connector 12 shown in FIG. 5.

As shown in FIG. 5 and FIG. 6, the guide portion 52 according to exemplary embodiment of the present invention includes a holder portion 54 integrally formed with the housing 50 and a tubular front holder 55 mounted so as to cover the holder portion 54. The front holder 55 has two protruding portions 56 along the axial direction on an inner peripheral surface thereof. The protruding portions 56 are formed at opposite positions across the central axis of the front holder 55. The protruding portions 56 are respectively fitted to the two groove portions 35 of the male terminal 30 inserted in the guide hole 53 of the guide portion 52.

As shown in FIG. 3 and FIG. 4, the female terminal 70 is formed of a conductive metal material, and is formed into a cylindrical rod shape. The female terminal 70 is accommodated in a terminal accommodating chamber 58 formed in the rear of the guide hole 53 in the housing 50. In the female terminal 70, a connection hole 71 is formed on the side of the tip end which is a connection end with the male terminal 30. The guide portion 52 is provided at the tip end which is a connection end of the female terminal 70 accommodated in the terminal accommodating chamber 58, and the connection hole 71 of the female terminal 70 communicates with the guide hole 53 of the guide portion 52. A joint hole 72 is formed at the rear end portion of the female terminal 70, and a conductor 74 of a power feeding cable 73 drawn out from the rear end of the housing 50 is inserted into the joint hole 72 and is caulkingly fixed to the joint hole 72.

A contact member 80 is provided in the connection hole 71 of the female terminal 70. The contact member 80 is fitted and accommodated in an annular recessed portion 75 formed on the inner peripheral surface of the connection hole 71 of the female terminal 70. The contact member 80 is formed of a metal plate having conductivity and elasticity, and is accommodated in the recessed portion 75 of the connection hole 71 in a state of being rolled into a cylindrical shape. The contact member 80 includes a pair of connecting plate portions 81 extending in the peripheral direction in a state of being accommodated in the connection holes 71, and a plurality of spring piece portions 82 connected with both ends of the connecting plate portions 81.

The intermediate portions of the spring piece portions 82 include contact portions 83. The intermediate portions of the spring piece portions 82, which are formed as the contact portions 83, are twisted and inclined inward in the radial direction. The contact portions 83 of the spring piece portions 82 are formed to be wide.

The inner diameter of the contact member 80 is smaller than the outer diameter of the male terminal 30 in a state of being accommodated in the connection hole 71, the contact member 80 passing through the inner peripheral side edges of the contact portions 83 of the spring piece portions 82. In the contact member 80, the spring piece portions 82 are elastically deformed by the male terminal 30 inserted into the connection hole 71 of the female terminal 70, and the contact portion 83 is pressed against the outer peripheral surface of the male terminal 30 by an elastic force to be in contact with the male terminal 30. The contact member 80 is preferably accommodated in the recessed portion 75 such that the groove portions 35 of the male terminal 30 are disposed in portions where there are not the spring piece portions 82, in a state where the male terminal 30 is inserted into the connection hole 71 of the female terminal 70.

Next, a case where the second connector 12 is connected to the first connector 11 will be described.

First, the connection portion 12*a* of the second connector 12 is brought close to the connection portion 11*a* of the first connector 11 and brought into contact with each other.

Then, the hood portion 21 formed in the housing 20 of the first connector 11 is fitted into the fitting recessed portion 51 formed in the housing 50 of the second connector 12, and the guide portion 52 of the second connector 12 is fitted into the fitting hole 25 of the first connector 11. And then, the male terminal 30 is inserted into the guide hole 53 provided in the guide portion 52, and further inserted in the connection hole 71 of the female terminal 70. At this time, the protruding portions 56 protruding from the inner circumference of the guide hole 53 is inserted in the groove portions 35 formed in the male terminal 30.

After that, the contact portions 83 of the contact member 80 of the female terminal 70 contact to the outer peripheral surface of the male terminal 30, and the male terminal 30 and the female terminal 70 are electrically connected with each other. At this time, in the male terminal 30, portions where there are not the spring piece portions 82 of the contact member 80, in the state where the male terminal 30 is inserted into the connection hole 70 of the female terminal 70, are disposed in the groove portions 35. Therefore, in the contact member 80, the contact portions 83 of all the spring piece portions 82 come into contact with the outer peripheral surface of the male terminal 30, and an excellent conductive state can be secured.

Next, operations based on the above configuration will be described.

Figure 7:
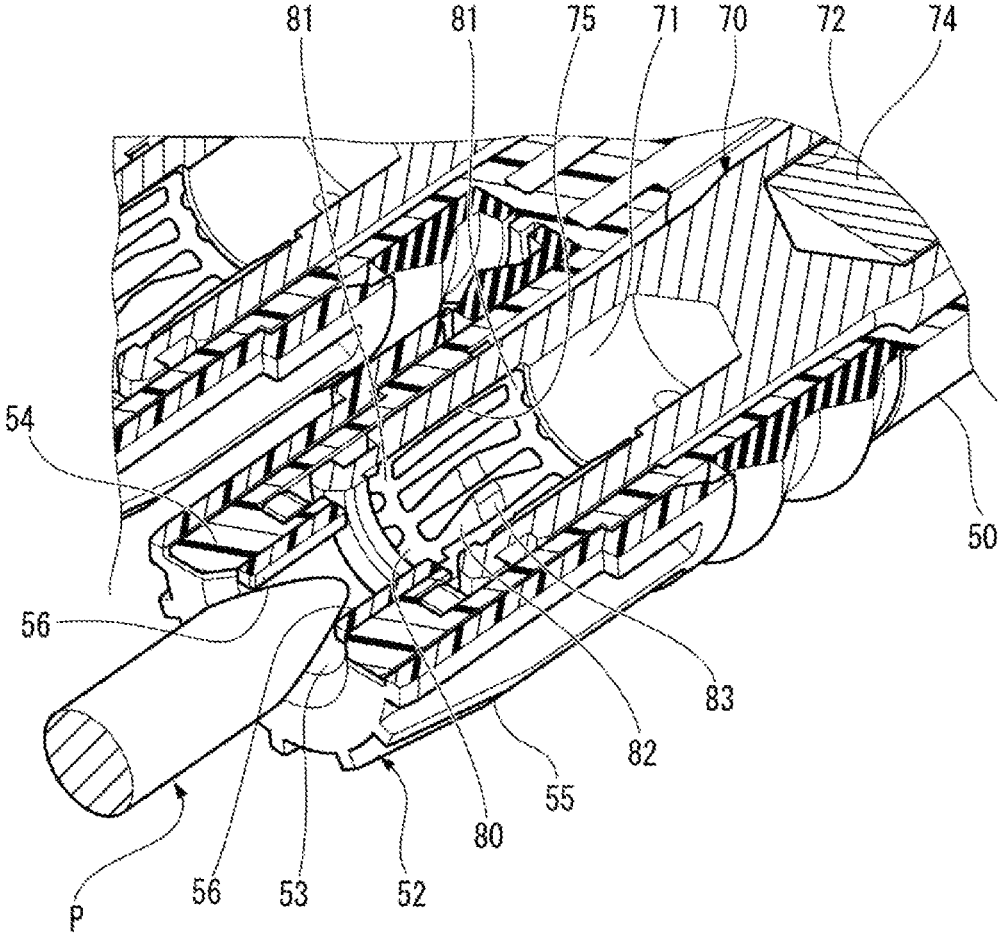
FIG. 7 is a perspective view illustrating a contact state of a test finger with respect to the female terminal in a cross sectional view of the female terminal.

FIG. 7 is a perspective view illustrating a contact state of a test finger P with respect to the female terminal 70 in a cross sectional view of the female terminal.

According to the connector device 10 based on the exemplary embodiments of the present invention, a pair of protruding portions 56 which is inserted through the two groove portions 35 formed on the male terminal 30 is provided on the inner peripheral surface of the guide hole 53 formed in the guide portion 52 made of an insulating resin, the guide hole 53 being provided in the connection end with the male terminal 30 in the female terminal 70. Accordingly, the guide hole 53 of the guide portion 52 connected to the female terminal 70 can be narrowed without preventing the connection with the male terminal 30. That is, as shown in FIG. 7, even when the test finger P assuming a finger is inserted into the guide hole 53 from the side of the tip end of the second connector 12, the test finger P can be prevented from reaching the female terminal 70 by bringing into contact with the protruding portions 56 and sufficient safety can be ensured. As described above, by increasing the diameter of the male terminal 30 in order to cope with the large current, even when the diameter of the guide hole 53 increases, the finger touch prevention can be secured with respect to the conductive portion of the female terminal 70 while suppressing the increase in size.

According to the connector device 10 based on the exemplary embodiment of the present invention, the guide portion 52 is an insulating resin component to be assembled to the connection end of the female terminal 70. Therefore, by assembling the guide portion 52 formed as an insulating resin component to the connection end of the female terminal 70, an excellent finger touch prevention with respect to the conductive portion of the female terminal 70 can be easily secured.

Further, according to the connector device 10 based on the exemplary embodiments of the present invention, the guide portion 52 includes a holder portion 54 integrally formed with the housing 50 for accommodating the female terminal 70 and a front holder 55 assembled to the holder portion 54. The protruding portion 56 are provided on the front holder 55. Therefore, in the guide portion 52 including the holder portion 54 integrally formed with the housing 50 and the front holder 55 assembled to the holder portion 54, by providing the protruding portions 56 on the front holder 55, the guide hole 53 connected to the female terminal 70 can be narrowed, and an excellent finger touch prevention can be easily secured.

The scope of the present invention is not limited to the exemplary embodiments described above, and may be appropriately modified, improved, or the like. In addition, materials, shapes, sizes, numbers, arrangement positions, or the like of elements in the above-described exemplary embodiments are selectable and not limited as long as the present invention can be achieved.

For example, in the exemplary embodiment described above, the protruding portions 56 are formed in the front holder 55, but the protruding portions 56 may be provided in the holder portion 54 of the housing 50, or may be provided in both the front holder 55 and the holder portion 54.

In addition, a separate guide portion 52 formed of a cap which is made of an insulating resin on which the guide hole 53 having the protruding portions 56 is formed may be assembled to the connection end formed at the tip end of the female terminal 70. As described above, by assembling the guide portion 52 formed of the separate insulating resin component to the connection end of the female terminal, an excellent finger touch prevention with respect to the female terminal 70 can be easily secured.

According to an illustrative aspect of the present invention, a connector device 10 has a first connector 11 including a male terminal 30 which is rod-shaped, and a second connector 12 including a female terminal 70 to which the male terminal 30 is electrically connected, in which the second connector 12 includes an guide portion 52 which is made of an insulating resin, the guide portion 52 includes a hole portion 53 for guiding the male terminal 30 to the female terminal 70 such that the hole portion 53 is formed to have a diameter larger than an outer diameter of the male terminal 30, at least one groove portion 35 is formed on an outer peripheral surface of the male terminal 30 in an axial direction of the male terminal 30, and a protruding portion 56 is provided on an inner peripheral surface of the hole portion 53, the protruding portion 56 being inserted through the groove portion 35 of the male terminal 30 to be inserted into the hole portion 30 and connected to the female terminal 70.

According to another illustrative aspect of the present invention, the guide portion 52 is formed as a component to be assembled to the connection end of the female terminal 70.

According to another illustrative aspect of the present invention, the guide portion 52 further includes a holder portion 54 integrally formed with a housing in which the female terminal 70 is accommodated; and a front holder 55 to be assembled to the holder portion 54, in which the protruding portion 56 is provided on at least one of the holder portion 54 and the front holder 55.

REFERENCE SIGNS LIST

10 Connector device
11 First connector
12 Second connector
30 Male terminal
35 Groove portion
50 Housing
52 Guide portion
53 Guide hole (Hole portion)
54 Holder portion
55 Front holder
56 Protruding portion
70 Female terminal

What is claimed is:

1. A connector device comprising:

a first connector including a male terminal which is rod-shaped; and a second connector including a female terminal to which the male terminal is electrically connected, wherein the second connector includes a a guide portion which is made of an electrically insulating resin, wherein the guide portion is provided in a connection end of the female terminal with the male terminal, wherein the guide portion includes a hole portion for guiding the male terminal to the female terminal such that the hole portion is formed to have a diameter larger than an outer diameter of the male terminal, wherein at least one groove portion is formed on an outer peripheral surface of the male terminal in an axial direction of the male terminal, and wherein a protruding portion is provided on an inner peripheral surface of the hole portion, the protruding portion being inserted through the groove portion of the male terminal to be inserted into the hole portion and connected to the female terminal.

2. The connector device according to claim 1, wherein the guide portion is formed as a component to be assembled to the connection end of the female terminal.

3. The connector device according to claim 2, wherein the guide portion further includes:

a holder portion integrally formed with a housing in which the female terminal is accommodated; and a front holder to be assembled to the holder portion, wherein the protruding portion is provided on at least one of the holder portion and the front holder.

4. The connector device according to claim 1, the second connector further includes an annular recessed portion in which a contact member is fitted and accommodated, the contact member being made of a metal plate.

* * * * *